US010051947B2

(12) United States Patent
Sisante

(10) Patent No.: US 10,051,947 B2
(45) Date of Patent: Aug. 21, 2018

(54) CONVERTIBLE BACKPACK BABYCHAIR

(71) Applicant: Primo Antonio Sisante, Houston, TX (US)

(72) Inventor: Primo Antonio Sisante, Houston, TX (US)

( * ) Notice: Subject to any disclaimer, the term of this patent is extended or adjusted under 35 U.S.C. 154(b) by 0 days.

(21) Appl. No.: 15/731,436

(22) Filed: Jun. 8, 2017

(65) Prior Publication Data

US 2017/0354238 A1 Dec. 14, 2017

Related U.S. Application Data

(60) Provisional application No. 62/392,785, filed on Jun. 10, 2016.

(51) Int. Cl.

| | |
|---|---|
| ***A45F 4/02*** | (2006.01) |
| ***A45F 3/04*** | (2006.01) |
| ***A47D 1/02*** | (2006.01) |
| ***A47D 1/10*** | (2006.01) |

(52) U.S. Cl.

CPC ..... *A45F 4/02* (2013.01); *A45F 3/04* (2013.01); *A47D 1/02* (2013.01); *A47D 1/106* (2013.01); *A45F 2004/026* (2013.01)

(58) Field of Classification Search

CPC . A45F 2004/026; A45F 4/02; A45C 2009/002

USPC ..... 224/155, 581, 584; 297/4, 129

See application file for complete search history.

(56) References Cited

U.S. PATENT DOCUMENTS

| | | | | | |
|---|---|---|---|---|---|
| 2,480,402 | A * | 8/1949 | Elston | A47C 1/16 | 224/155 |
| 3,690,525 | A * | 9/1972 | Albert Eugene Koons | B60N 2/283 | 224/155 |
| 3,909,061 | A * | 9/1975 | Johnson | A47C 4/52 | 297/17 |
| 4,312,535 | A * | 1/1982 | Smith | A47D 1/106 | 297/134 |
| 4,367,829 | A * | 1/1983 | Kusz | B62J 7/04 | 224/415 |
| 4,392,598 | A * | 7/1983 | Dixon | A45F 4/02 | 224/155 |
| 4,469,373 | A * | 9/1984 | Simmons | A47D 1/106 | 297/174 CS |
| 4,506,928 | A * | 3/1985 | Marion | A47D 1/106 | 297/134 |
| D284,910 | S * | 8/1986 | Handy | D3/217 | |
| 4,955,517 | A * | 9/1990 | Maresca | A45F 4/02 | 224/155 |
| 5,016,792 | A * | 5/1991 | Jay | A45F 4/02 | 224/153 |
| 5,046,651 | A * | 9/1991 | Dagdagan | A47D 1/04 | 224/153 |
| 5,289,958 | A * | 3/1994 | Jay | A47C 4/52 | 224/153 |
| 5,409,291 | A * | 4/1995 | Lamb | A01K 97/10 | 224/155 |
| 5,470,127 | A * | 11/1995 | Kassai | A47D 1/106 | 224/161 |
| 6,986,445 | B1 * | 1/2006 | Stockman | A45F 4/02 | 224/155 |

(Continued)

*Primary Examiner* — Brian D Nash

(57) ABSTRACT

A backpack converts into a babychair. The babychair is adapted to attach to a table and to allow a human child to sit in the babychair while facing the table. The babychair converts into a backpack for convenient transport and storage.

6 Claims, 8 Drawing Sheets

(56) References Cited

U.S. PATENT DOCUMENTS

2007/0084891 A1* 4/2007 Gillespie ..... A45F 4/02
224/155

* cited by examiner

FIG. 4 SUP-06A0 Baby Seat

FIG 6 Grip Assembly

FIG 7 Pivot Leg Assembly

FPO-0600 "Jandro" Backpack/Baby Seat Combo
(Baby Seat Assembly inside the Backpack)

CONVERTIBLE BACKPACK BABYCHAIR

CROSS REFERENCE TO RELATED APPLICATIONS

This application claims priority to U.S. Provisional Application No. 62/392,785, which was filed on Jun. 10, 2016, the entire contents of which are incorporated hereby by reference.

SUMMARY OF THE INVENTION

A convertible backpack-babychair assembly includes two shoulder straps to be worn over the shoulders of an adult. The assembly includes two side panels, an upper compartment and a lower compartment. The two side panels open to reveal two legs. The two legs are connected via a bracket.

The bracket allows each leg to rotate 180 degrees, from a "closed" position (in the backpack configuration) to an "open" position (in the babychair configuration) and vice versa. The upper end of each leg includes an attachment means, such as an adjustable vise like grip assembly, that is placed into contact with the upper (or top) and lower (or bottom) surfaces of a table. On the opposite end from the attachment means is a contacting means, such as a pivoting leg assembly that optionally also includes an adjustable end cap, that is placed into contact with the lower (or bottom) surface of the table.

A human child may be placed into the seat, facing the table. The child is placed in the seat with the child's back against the seat back. Two straps connecting the seat back to the seat bottom prevent the seat back from reclining more than 90 degrees away from the seat bottom. In addition, a latch on each side of the seat back is engaged with a mating latch on each leg, which prevents the seat back from reclining more than 90 degrees away from the seat bottom. The seat bottom's lower surface contacts the bracket's upper surface; optionally, these two surfaces are held together via Velcro, snaps, or mating grooves running parallel to the legs.

DETAILED DESCRIPTION

Figure 1:
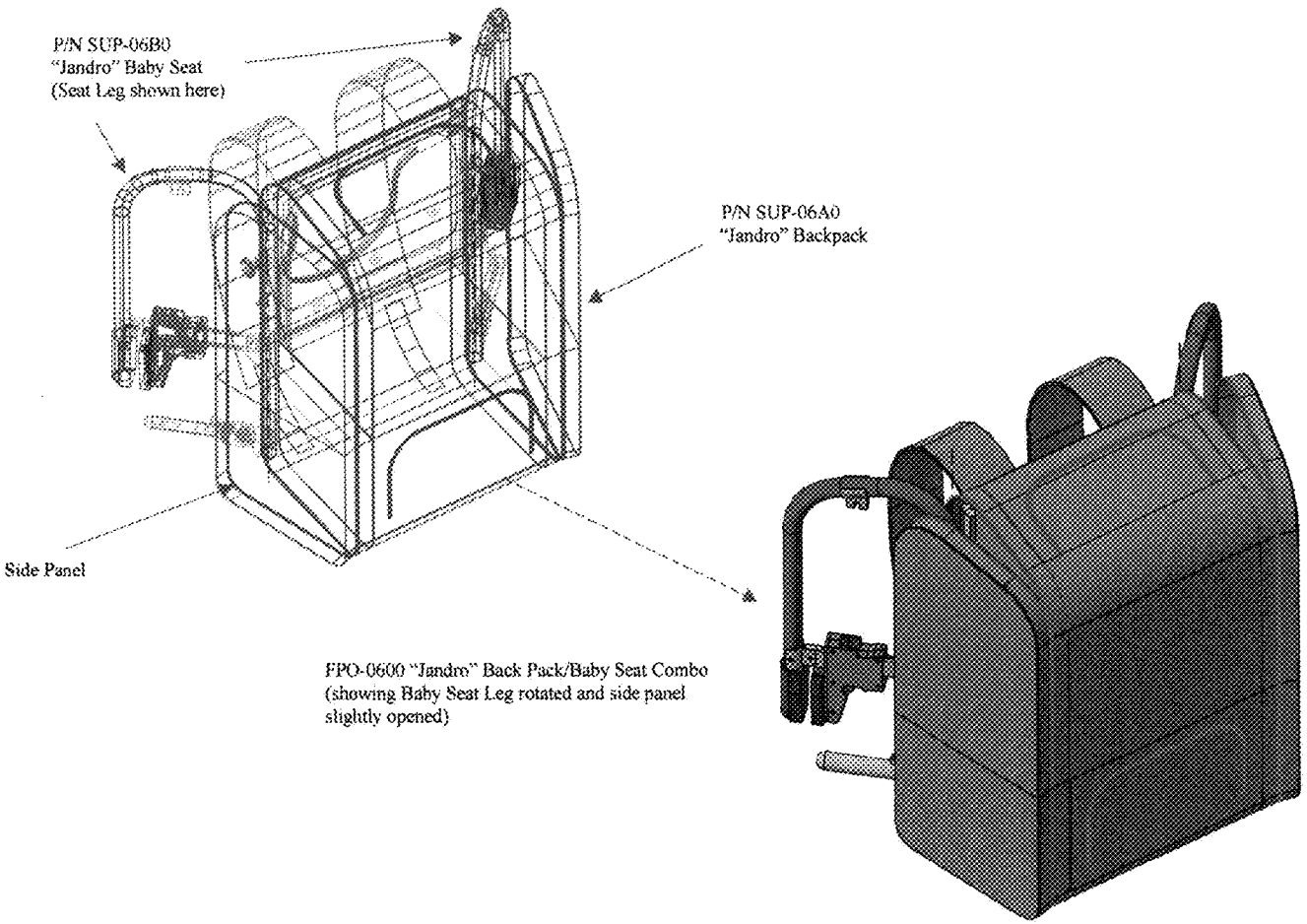
FIG. 1 is an aerial 3D and exploded side views of an exemplary embodiment of the invention when the embodiment is configured as a backpack with slightly opened side panels.

Referring to FIG. 1, a convertible backpack-babychair is configured as a backpack. The backpack includes two shoulder straps to be worn over the shoulders of an adult. The backpack includes a side panel on each side of the backpack. Each side panel may be opened or closed (via a zipper, snaps, Velcro, or other fastening means) to reveal a seat leg. Each seat leg may rotate about an axis (each shown as a dashed vertical line extending above and below the backpack). As depicted in FIG. 1, each leg is shown to be rotated approximately 45 degrees away from its respective "closed" position. The "closed" position of a seat leg is defined herein as the position of the seat leg that allows its respective side panel to be closed and to thus hide the seat leg. The "open" position of a seat leg is defined herein as the position of the seat leg when the convertible backpack-babychair is configured as a babychair. In this exemplary embodiment, the "closed" position is 0 degrees, and the "open" position is approximately 180 degrees.

The backpack in FIG. 1 includes an upper and lower compartment. The upper and lower compartments house a seat (not shown) and may house other things such as diapers, milk bottles and other objects (not shown). The upper and lower compartments are sewn together at the front edge of the compartments. The opposite back edge of the compartments is attached to one another via a Velcro, belt-buckle strap or other fastening means. As depicted in FIG. 1, the shoulder straps are integrally connected to both the upper and lower compartment. Preferably, the straps, the upper and lower compartments, and the side panels are made of a durable, washable fabric material, such as Cordura®.

Figure 2:
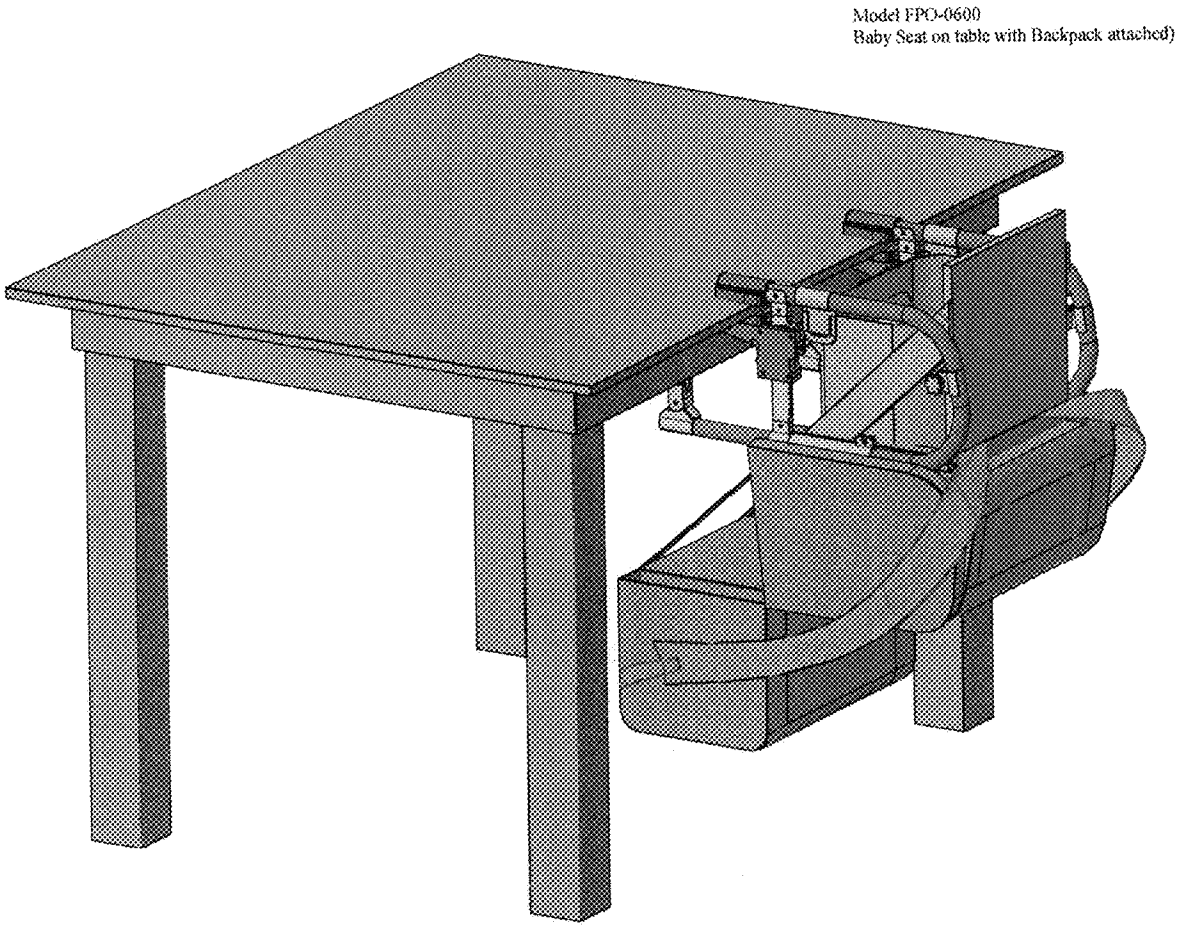
FIG. 2 is an aerial side view of an exemplary embodiment of the invention when the embodiment is configured as a babychair attached to a table, wherein the storage compartments are attached to the babychair.

Referring to FIG. 2, a convertible backpack-babychair is configured as a babychair (also referred to as a "baby seat") that is attached to a table. The attachment of the babychair to the table occurs by the weight of the babychair acting on the top and bottom surfaces of the table and/or by the attachment means acting on the top and bottom surfaces of the table, as well as the contacting means acting on the bottom surface of the table. babychair. The babychair includes a seat (preferably made of fabric, such as Cordura®) and two legs (preferably made of metal, such as aluminum). As depicted in FIG. 2, each leg is in the "open" position (rotated approximately 180 degrees away from the respective sides of the backpack's upper compartment).

At the upper end of each leg is an attachment means for attaching the babychair to the table. In an embodiment, the attachment means is an adjustable vise like grip assembly that grips the top and bottom surfaces of the table nearest the seat. The vise like grip assembly includes an upper end cap and a lower end cap that are preferably made of rubber or other non-stick material that contacts the top and bottom surfaces of the table. The lower end cap of the assembly is attached to a grip housing that includes a trigger that slides upwards on a reinforcing bar that connects the upper and bottom horizontal portions of each seat leg. The trigger can slide easily and unidirectionally upwards but will not slide downwards unless a safety release latch located at the rear end of the grip housing is pressed. The vise like grip assembly is described in further detail in connection with FIG. 6 (Grip Assembly).

At the opposite end of each leg (i.e., opposite the vice like grip assembly) is a contacting means for contacting the babychair to the table by contacting the bottom surface of the table. In an embodiment, the contacting means is a pivoting leg assembly that can pivot and lock at various angles (e.g., 90°, 75°, 60°, 45°, 30°, 15° or 0° angle relative to the horizontal bottom section of the seat leg). The pivoting leg assembly may also include an adjustable end cap for minor height adjustment. The end cap is preferably made of rubber or other non-stick material that contacts the bottom surface of the table. The adjustable pivoting leg assembly can accommodate various thickness of the table and also can maneuver around an obstructing apron of the table. The adjustable pivoting leg assembly is discussed in greater detail in connection with FIG. 7 (Pivot Leg Assembly).

The seat has a back and a bottom approximately perpendicular to one another when unfolded, which allows a human child (not shown) to sit comfortably while facing the table. The seat back and bottom, each preferably having a satin finish, are reinforced with a plastic polyethylene panel and layered with Dacron® fiber fill or similar quality fill. An internal seat bucket, also with satin finish, is clamped on each side of the seat leg and attached by Velcro against the seat back.

As depicted in FIG. 2, the backpack-babychair includes a backpack having upper and lower compartments attached to the seat. The upper and lower compartments can optionally be detached from the seat when positioned at the table. As depicted in FIG. 2, the upper and lower compartments are attached to the seat; for example, the lower compartment is opened and rotated with respect to its interface with the upper compartment, resulting in the lower compartment being positioned approximately perpendicular to the floor, thereby optionally serving as a footrest for the child when sitting in the seat and additionally provides convenient access to the opening of the bottom compartment. Two straps connect the upper and lower compartments in order to hold the lower compartment in the perpendicular position. The strap runs at an approximately 45-degree angle from the rear lower edge of the upper compartment to the rear upper edge of the lower compartment, thereby holding the lower compartment in an open position, such that the lower compartment is perpendicular to the floor and optionally serves as a footrest for the child when sitting in the seat.

Figure 3:
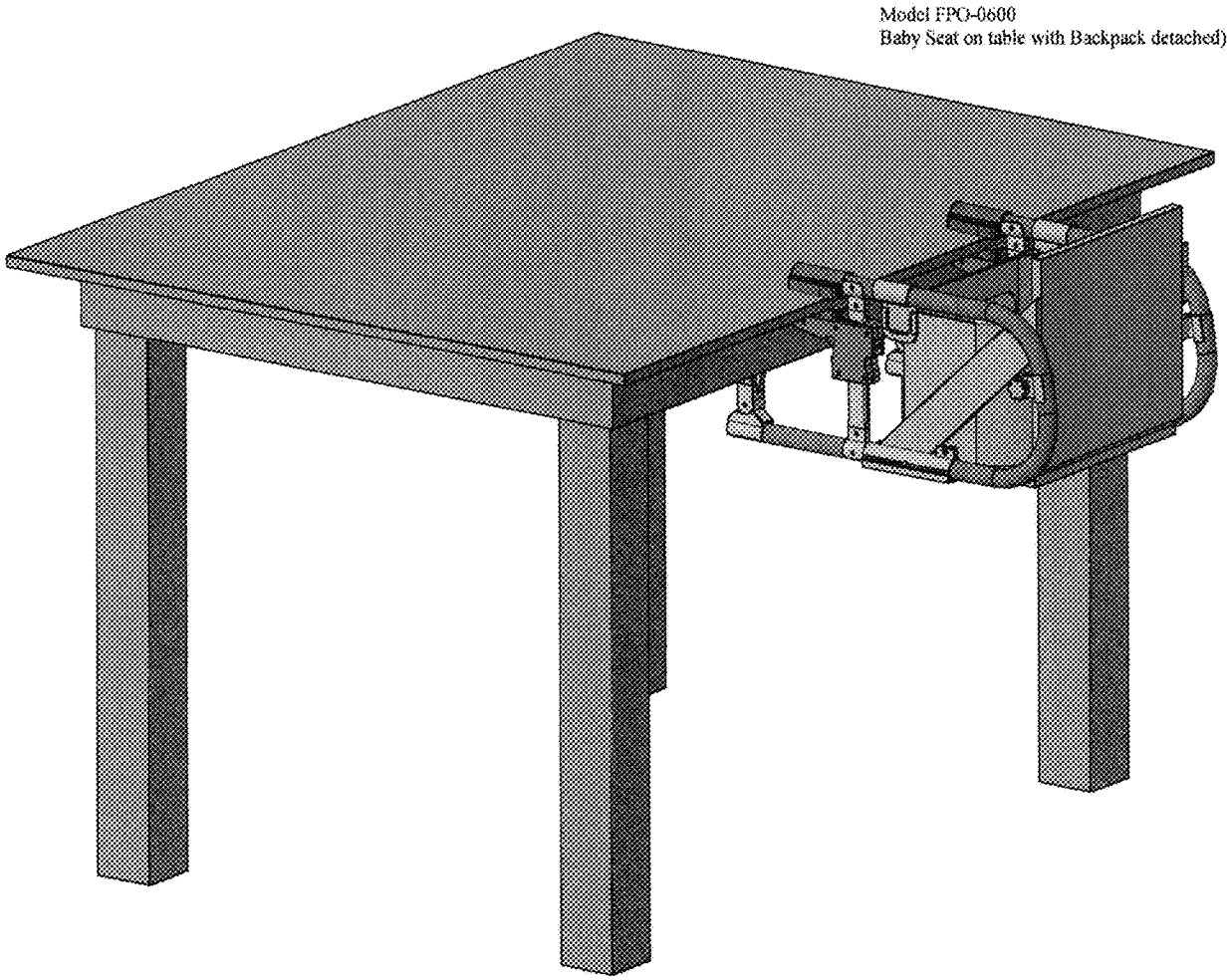
FIG. 3 is an aerial side view of an exemplary embodiment of the invention when the embodiment is configured as a babychair attached to a table, wherein the backpack is detached from the babychair.

Referring to FIG. 3, the backpack-babychair is attached to a table, and the upper and lower compartments are detached from the seat. The seat may include a safety belt (not shown) to secure the child to the seat.

Figure 4:
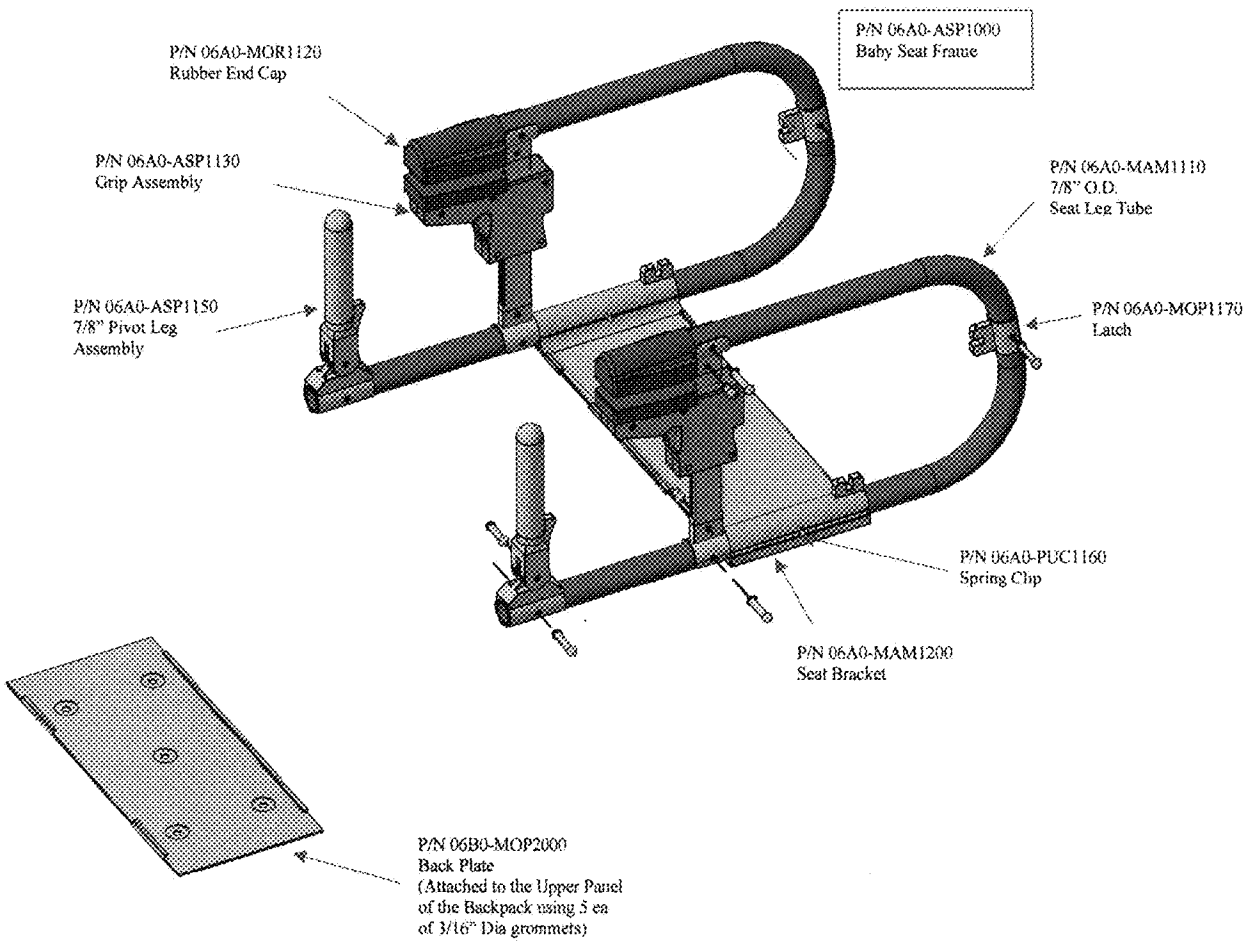
FIG. 4 is an aerial side view of an exemplary embodiment of the invention when the embodiment is configured as a babychair that is not attached to a table, wherein the storage compartments are detached from the babychair.

Referring to FIG. 4, the backpack-babychair is shown as removed from the table. The seat legs are held together by a seat bracket at the bottom section of the seat legs. The seat (not shown) is made up of a seat back and a seat bottom which are sewn together where the two meet. The seat bottom sits on the seat bracket and held together by Velcro. The seat back is attached to the pair of seat legs by latches located on both sides of the seat back and can engage and lock against mating latches on each seat leg located on the portion of the seat leg farthest from the table, thereby locking the seat back in place while configured as a babychair and preventing the seat back from reclining more than 90 degrees away from the seat bottom. Additionally, an internal seat bucket sits on top of the seat bottom is are held in place by attaching by clamps sewn on both upper sides of the seat bucket. The seat bucket is further attached to the seat back by Velcro. The seat bucket, preferably with satin texture and filled with fiberfill, is designed to allow easier cleaning of the seat bucket. In addition, the seat back can fold towards the seat bottom with the seat bucket tucked in between when converting the babychair to the backpack configuration. When folding the seat back towards the seat bottom, the latch on the seat back can engage and lock against a mating latch located on the seat bracket that connects the seat legs, thereby allowing the seat back to be locked in place while in the backpack configuration.

As shown in FIG. 4, each leg has an adjustable pivoting leg assembly at the lower end of the seat leg. The pivoting leg assembly can be pivoted and locked at various angles (90°, 75°, 60°, 45°, 30°, 15° or 0° angle relative to the horizontal bottom section of the seat leg) that will provide the ideal height clearance needed to keep the baby seat horizontal to the table when the adjustable end cap of this pivoting leg assembly contacts the bottom surface of the table. The adjustable end cap attached to the end of this pivoting leg assembly serves as an additional height adjustment if adequate contact has not been achieved by the desired height clearance of the selected pivot angle of the pivoting leg assembly. The desired pivot angle is selected by engaging and disengaging a sliding spring mounted release latch within the assembly housing. This pivoting leg assembly with adjustable end cap thereby accommodates various thickness of the table. The pivoting leg assembly also facilitates the setup of the seat leg by allowing the pivoting leg assembly to open up and thereby easily clear any encumbering table aprons.

Figure 5:
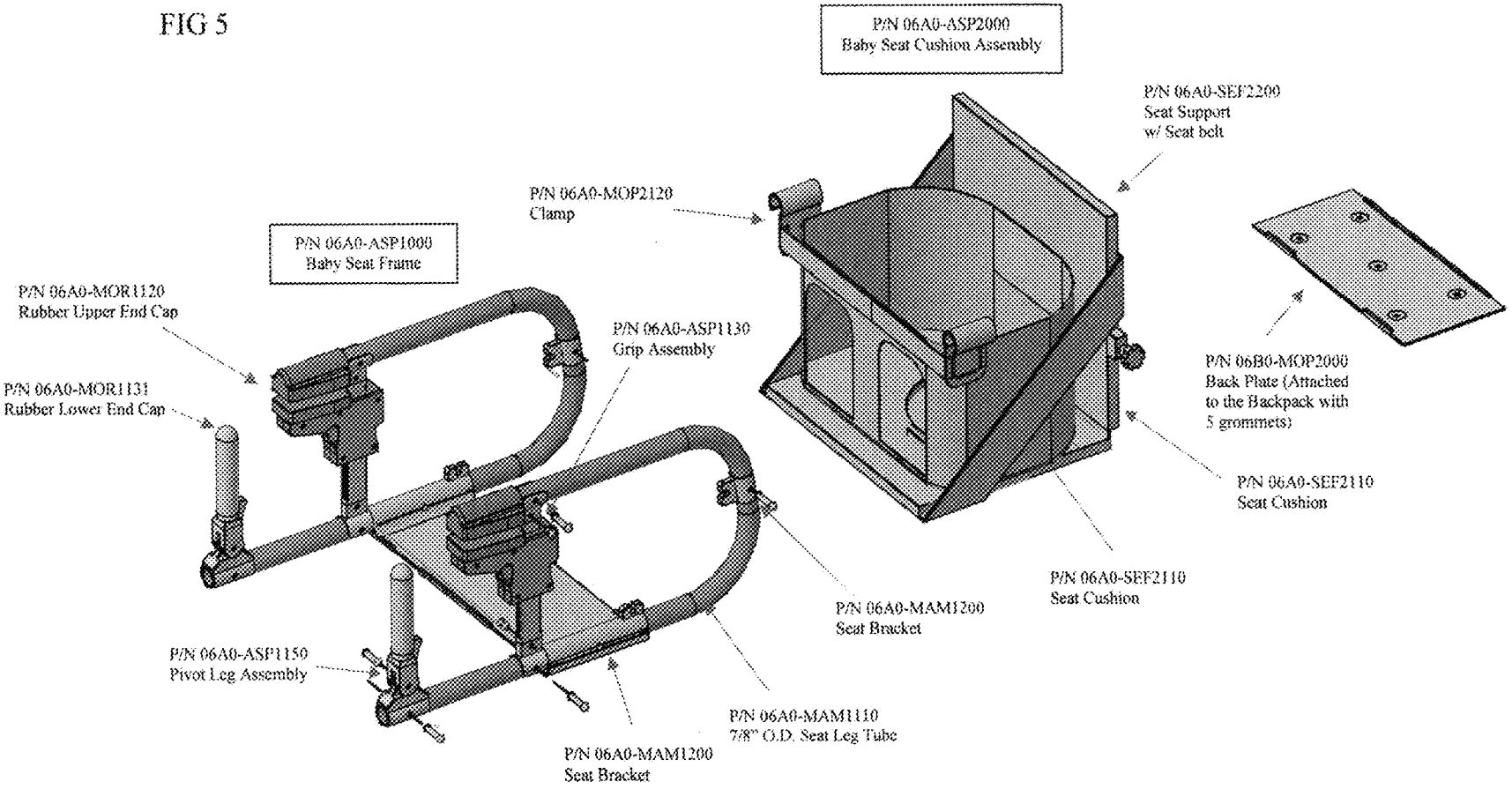
FIG. 5 is an aerial side view of an exemplary embodiment of the invention when the embodiment is configured as a babychair that is not attached to a table, wherein the storage compartments are detached from the babychair, and wherein the washable seat cushion is detached from the frame.

Referring to FIG. 5, the seat is shown as being detached from the legs. The two legs are connected to one another via a seat bracket. The seat bracket can be made of plastic. For example, the seat bracket is made of polyethylene or other material of similar strength and toughness. The upper surface of the bracket may include a fastener (not shown), such as Velcro, which fastens to the bottom surface of the seat. Alternatively, the bottom surface of the bracket includes grooves that mate with corresponding grooves on the plate which is attached to the back of the upper compartment of the backpack (not shown). For example, the grooves may be trapezoidal in cross-section, which slidably engage in a direction parallel to the legs, thereby preventing the bracket from becoming detached from the backpack in a direction perpendicular to the floor, until the backpack is slid with respect to the bracket in the parallel direction.

As shown in FIG. 5, the seat bracket contains "U" grooves that allow each leg to rotate from the "closed" position (0 degrees) to the "open" position (180 degrees), and vice versa. The grooves contain spring-loaded pins that lock the legs in either the "closed" or "open" position. The legs in FIG. 5 are shown to be in the "open" position.

Figure 6:
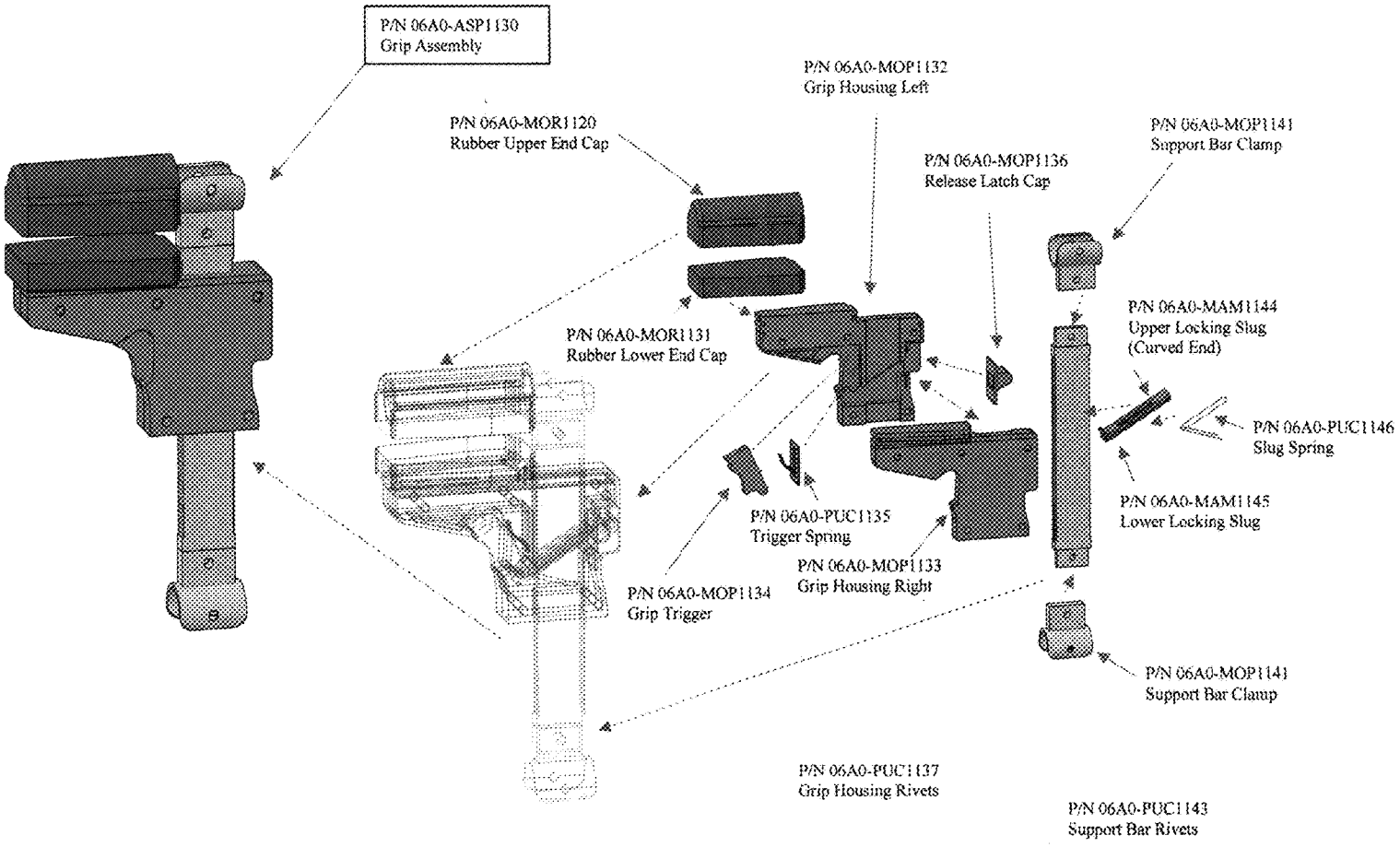
FIG. 6 is a 3D, wireframe and exploded views of an exemplary embodiment of the invention showing the internal and external components of the adjustable vise like grip assembly.

Referring to FIG. 6, the vice like grip assembly includes a pair of matching rubber end caps that contact the table. The upper end cap is attached to the upper end of the seat leg. The lower end cap is attached to (or is part of) a grip housing that slides vertically along a ribbed plastic bar. The ribbed plastic bar connects the upper and lower horizontal portions of the seat legs via two support bar clamps. The ribbed plastic bar thereby helps prevents the two ends of the seat legs from being forced apart under tension. The ribbed plastic bar adds strength to the seat legs that supports the prescribed weight limits of the baby and any attached backpack.

Within the grip housing is a pair of slug stops positioned at a 30° angle such that the inner edges of the stops are pressed against the teeth (ribbed edges) of the ribbed plastic bar. The teeth (ribbed edges) of the ribbed plastic bar may be located along the entire length or a portion of the length of the plastic bar. The jagged teeth of one side of the bar, as viewed from a magnifying glass, is angled at 60° on upper face of the jagged tooth and 30° on the lower face. The opposite edge of the bar is configured with opposite angles (30° upper face and 60° on the lower face). This allows the slug stops to wedge against the teeth of the bar when the slug stops are positioned at a 30° angle within the serrated bar. A trigger (encased within the grip housing) rests against the top portion of lower angled end of the slug stops. When the grip housing reaches the uppermost height (as when the lower rubber pad is pressed against the bottom surface of the table), the trigger will add additional incremental pressure to keep the rubber end caps tightly pressed against the upper and lower surfaces of the table. The pressure between the end caps is released when the release latch at the rear end of the grip housing is pressed downwards. The release latch is connected to the elevated end of the slug stops. When the latch is pressed downwards, the locking slug disengages itself against the teeth of the ribbed bar and thus allows the grip assembly to slide down the bar.

Figure 7:
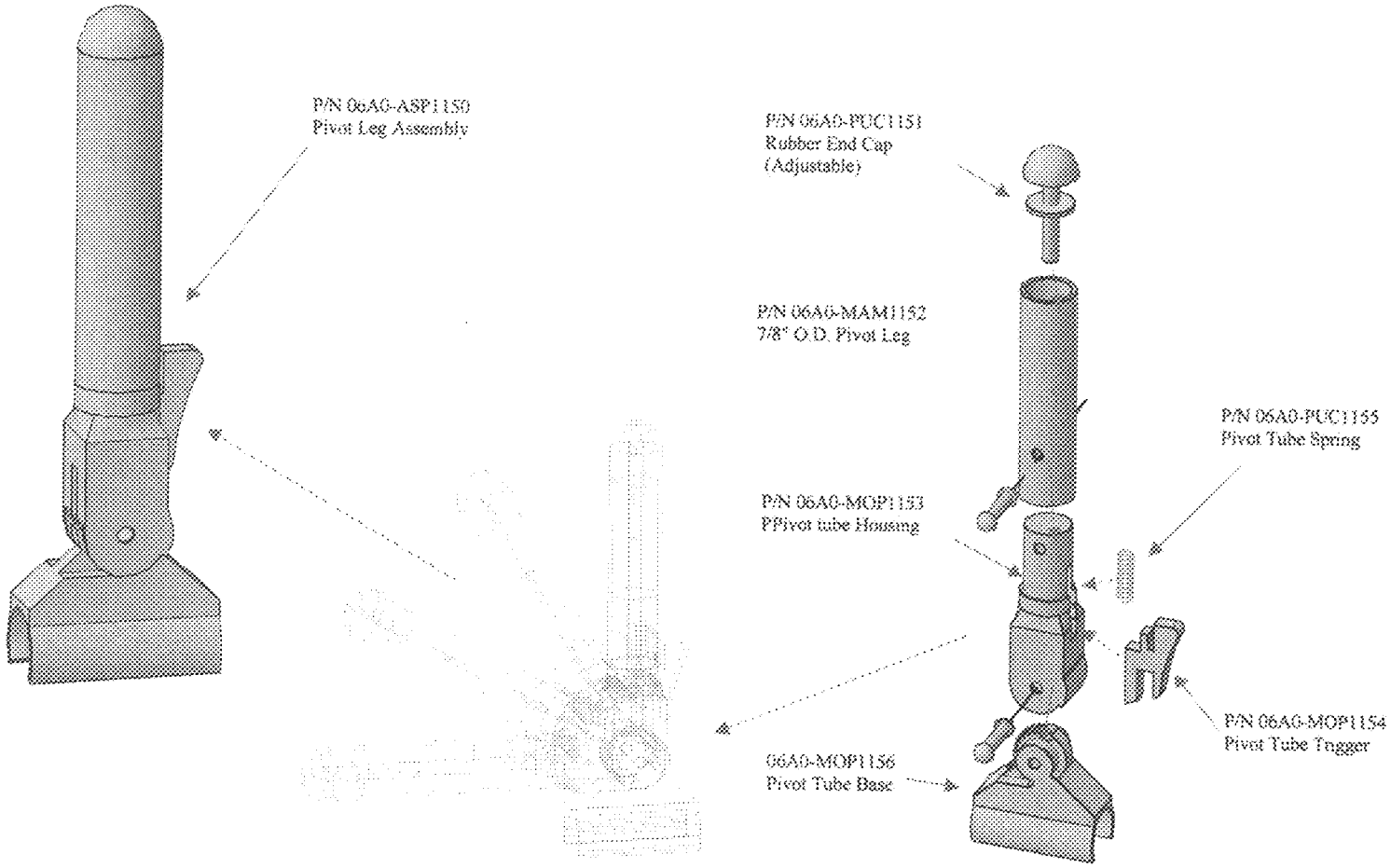
FIG. 7 is the 3D, wireframe and exploded views of an exemplary embodiment of the invention showing the internal and external components of the pivoting leg assembly.

Referring to FIG. 7, the pivoting leg assembly includes a leg tube that is attached to a pivot tube base that will allow the tube to pivot and lock at various angles (90°, 75°, 60°, 45°, 30°, 15° or 0° angle) relative to the horizontal bottom section of the seat leg. As shown in FIG. 7, the leg tube is in the vertical position (90° relative to the horizontal bottom section of the seat leg). This will enable the pivoting leg to be configured such that will the ideal height clearance needed to keep the baby seat horizontal to the table can be achieved when the end cap contacts the bottom surface of the table. By rotating the adjustable end cap within the pivot leg, the height of the end cap can be adjusted via minute adjustment, if the ideal height adjustment is not achieved by the selected angle of the pivot tube. The pivot leg when configured horizontally (i.e., 0° angle) facilitates the setup of the entire seat assembly as it provides generous clearance between the upper and lower sections of the seat leg, thereby preventing obstructions from any encumbrances from the table such as a wide apron.

Figure 8:
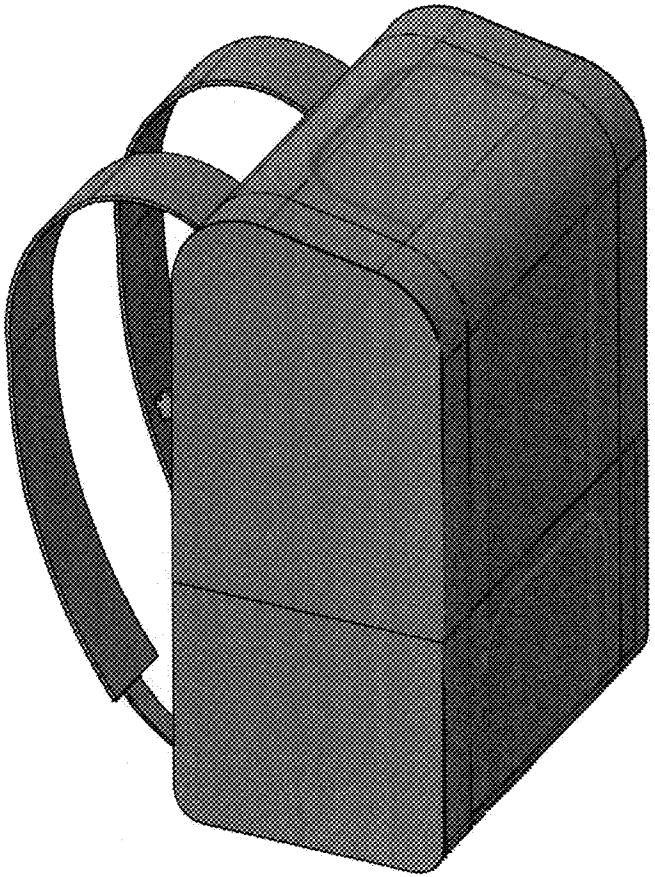
FIG. 8 is an aerial view of an exemplary embodiment of the invention when the embodiment is configured as a backpack.

Referring to FIG. 8, the convertible backpack-babychair is shown to be in the backpack configuration. Each leg is in the "closed" position, hidden by each side panel of the backpack. The upper and lower compartments are both shown as being closed. As shown in FIG. 8, the backpack is ready to be worn and transported by an adult.

EXAMPLES

TABLE 1 below contains the specifications of an exemplary embodiment of the convertible backpack-babychair. The table is arranged in such a way that the indentions under the description column constitutes the hierarchy (or order) in which the parts are assembled. Reference to the labor component of the assembly are also listed in the table. The dimensions in TABLE I can be varied. For example, the outer diameters, inner diameters, and thicknesses in TABLE 1 can be varied by about ±50%, ±40%, ±30%, ±20%, ±10%, or ±5%.

TABLE 1

| Part No | OM | ty | Description | Specification |
|---|---|---|---|---|
| FP0-0600 | a | | "Jandro" Backpack/Baby Seat Combo | Packaged Assembly |
| SUP-06A0 | a | | Baby Seat | Manufactured Sub Product |
| 06A0-ASP1000 | a | | Baby Seat Frame | Manufactured Sub-Assembly |
| 06A0-ASP1100 | a | | Baby Seat Leg | Sub-Assembly (2 Seat Legs Per Unit) |
| 06A0-MAM1110 | a | | ⅞" O.D. Seat Leg Tube | ⅞" dia., 16 ga. (0.060" dia) Seam Welded Aluminum Tube |
| 06A0-LAB1110 | h | .008 | Bend Pivot Leg Tube two places | Bend ⅞" Dia pivot leg two places with 3" radius |
| 06A0-MOR1120 | a | | Rubber Upper End Cap | Molded Rubber End Cap-Upper (see design) |
| 06A0-ASP1130 | a | | Grip Assembly | Sub-Assembly |
| 06A0-MOR1131 | a | | Rubber Lower End Cap | Molded Rubber End Cap-Lower (see design) |
| 06A0-MOP1132 | a | | Grip Housing-Left | Molded Polyethylene Plastic-Left Housing (see design) |
| 06A0-MOP1133 | a | | Grip Housing-Right | Molded Polyethylene Plastic-Right Housing (see design) |
| 06A0-MOP1134 | a | | Grip Trigger | Molded Polyethylene Plastic-Trigger (see design) |
| 06A0-PUC1135 | a | | Trigger Spring | C-Spring (see design) |
| 06A0-MOP1136 | a | | Release Latch Cap | Molded Polyethylene Plastic-Cap (see design) |
| 06A0-PUC1137 | a | | Grip Housing Rivets | 3/16" Dia. × 0.5"L Rivets |
| 06A0-LAB1130 | h | .01 | Assemble Grip Assembly | Assemble Grip Assembly by attaching 5 rivets |
| 06A0-ASP1140 | a | | Support Bar Assembly | Fabricated Sub-assembly |
| 06A0-MOP1141 | a | | Support Bar Clamp | Molded Polyethylene Plastic (see design) |
| 06A0-MOP1142 | a | | Support Bar | Molded Polyethylene Plastic (see design) |
| 06A0-PUC1143 | a | | Support Bar Rivets | |
| 06A0-MAM1144 | a | | Upper Locking Slug (Curved End) | Stamped steel strip 2.125" L × 9/16" W and 1/16" T steel slug with a 1.125" L × 5/16" W rectangular slot-Curved end |
| 06A0-MAM1145 | a | | Lower Locking Slug | Stamped steel strip 2.125" L × 9/16" W and 1/16" T steel slug with a 1.125" L × 5/16" W rectangular slot |
| 06A0-PUC1146 | a | | Slug Spring | V-Shape Spring |
| 06A0-LAB1140 | h | .01 | Assemble Support Assembly | Assemble Support Assembly using two rivets |
| 06A0-ASP1150 | a | | Pivot Leg Assembly | Fabricated Sub Assembly made up of ⅞" dia., 16 ga. (0.060" Dia) and assembled into Pivot Housing and Base |
| 06A0-PUC1151 | a | | Rubber End Cap (Adjustable) | Adjustable Rubber End Cap for ⅞" O.D., 0.060" (16 ga) tube (¾" I.D.) |
| 06A0-MAM1152 | a | | ⅞" O.D. Pivot Leg Tube | ⅞" dia., 16 ga. (0.060" dia) × 3-½" Long; Seam Welded Aluminum Tube |
| 06A0-MOP1153 | a | | Pivot tube Housing | Injection molded Polyethylene plastic (see design) |

TABLE 1-continued

| Part No | OM | ty | Description | Specification |
|---|---|---|---|---|
| 06A0-MOP1154 | a | | Pivot Tube Trigger | Injection molded Polyethylene plastic (see design) |
| 06A0-PUC1155 | a | | Pivot Tube Spring | Coiled Spring-⅞" L × 0.12" R (10 Turns) |
| 06A0-MOP1156 | a | | Pivot Tube Base | Injection molded Polyethylene plastic (see design) |
| 06A0-PUC1157 | a | | ivets | Rivet-⅞" L × 3/16" D (5/16" head) |
| 06A0-LAB1150 | h | .004 | Assemble Pivot Leg | Assemble pivot tube housing to base with 1 rivet |
| 06A0-PUC1160 | a | | Spring Clip for ⅞" pipe | Spring Inner Tube V-clip used as locking mechanism for baby ⅞" dia. seat legs against the slotted seat plate |
| 06A0-MOP1170 | a | | Latch | Injection molded plastic latch (see design) |
| 06A0-LAB1100 | h | .005 | Attach Pivot Leg to Seat Leg Tube | Assemble pivot leg to seat tube with 1 rivet |
| 06A0-LAB1102 | h | .01 | Attach Support Bar to Seat Leg Tube | Assemble support bar to seat tube with 2 rivets |
| 06A0-MAM1200 | a | | Seat Bracket | Polyethylene Plastic Injection Molded Bracket (see design) |
| 06A0-ASP2000 | a | | Baby Seat Cushion Assembly | Fabricated Seat Sub-Assembly (Satin Finish) reinforced with a 0.060" plastic polyethylene panel for Seat and Back and layered with Dacronâ fiber fill (or similar quality fill) |
| 06A0-SEF2100 | a | | Seat Cushion Bucket w/ Clamp and Velcro | Assembled sub product; Sewn fabric (Satin Finish) in a seat configuration with two leg holes; filled with layer of Dacron fiber fill; with sewn Velcro and clamp |
| 06A0-SEF2110 | a | | Seat Cushion Bucket | Sewn fabric (Satin Finish) in a seat configuration with two leg holes; filled with layer of Dacronâ fiber fill |
| 06A0-MOP2120 | a | | Clamp | Molded polyethylene plastic clamp with slots to enable attachment of fabric and or straps |
| 06A0-SEF2130 | a | | Velcro | Velcro |
| 06A0-LAB2100 | h | .012 | Sew Clamp and Velcro to Seat Cushion | Sew Clamp on two upper side of the seat bucket and attached Velcro on back of Seat seat bucket |
| 06A0-MOP2200 | a | | Seat Back Plate with interlocking latch | Seat Back with a interlocking latch; such as an infused rod with screw ends |
| 06A0-MOP2300 | a | | Seat Bottom Plate | 0.060" plastic polyethylene panel (see design) |
| 06A0-SUP2400 | a | | Knob | Plastic screw-on knob |
| 06A0-SEF2500 | a | | Seat Back and Bottom fabric casing | Cordura fabric to form the seat back and bottom casing |
| 06A0-SEF2600 | a | | Seat Belt | Standard 1½" wide fabric seat belt |
| 06A0-LAB2000 | h | .200 | Insert Seat Back and Bottom Plates to seat fabric casing; sew seat belt to seat bottom; sew mating Velcro on seat back; sew casing shut | Sew Cordura fabric to form the seat back and bottom casing; infuse back and bottom plates to seat casing, attach mating Velcro and sew complete |
| SUP-06B0 | a | | Back Pack with Back Plate | Fabricated Sub-Assembly |
| 06B0-SEF1000 | a | | Back Pack | Fabricated Cordura (or similar quality fabric) Backpack with split upper and lower panels and side sleeve panels for seat leg tube storage (See Design) |
| 06B0-MOP2000 | a | | Back Plate | Molded polyethylene plastic plate with 5 mounting holes |
| 06B0-PUC3000 | a | | Grommets | Grommets-3/16" D × 5/16" head |
| 06B0-LAB0000 | h | .01 | Attach back plate to backpack using grommets | Attach back plate to backpack using grommets in 5 places |

What is claimed is:

1. A convertible backpack-babychair, comprising:

two shoulder straps configured to be worn over the shoulders of an adult;

two side panels;

an upper compartment;

a lower compartment;

two legs;

a bracket connecting the two legs; and a seat comprising a seat back and a seat bottom configured to allow a child to sit in the seat;

wherein:

the bracket is configured to allow each leg to rotate about 180 degrees between a first position and a second position;

the seat back is configured to fold onto the seat bottom and to unfold into an upright position no farther than about 90 degrees with respect to the seat bottom;

a lower surface of the seat bottom is in contact with an upper surface of the bracket;

each leg comprises an attachment means for attaching the leg to an upper surface and a lower surface of a table;

each leg further comprises a contacting means for contacting the leg to the bottom surface of the table;

the side panels are configured to open and close;

the side panels are configured to hide the legs when the panels are closed and the legs are in the stored position.

2. The backpack-babychair of claim 1, wherein:

the attachment means comprises an adjustable vice like grip assembly that comprises an upper end cap and a lower end cap that are configured to contact, respectively, the upper and lower surfaces of the table;

the lower end cap is configured to slide along a ribbed plastic bar that connects an upper horizontal portion and a bottom horizontal portion of each leg;

the contacting means comprises a pivoting leg assembly that comprises an adjustable end cap that is configured to contact the lower surface of the table.

3. The backpack-babychair of claim 2 configured to convert from a backpack configuration into a babychair configuration by:

opening the two side panels to reveal the two legs;

rotating each leg approximately 180 degrees from the first position to the second position;

unfolding the seat back into an upright position approximately 90 degrees with respect to the seat bottom;

placing the upper end cap of each leg into contact with the upper surface of the table;

sliding the lower end cap of each leg along the ribbed plastic bar to bring the lower end cap into contact with the lower surface of the table; and placing the end cap of the pivoting leg assembly into contact with the lower surface of the table.

4. The backpack-babychair of claim 2 configured to convert from a babychair configuration into a backpack configuration by:

removing the lower end cap from contact with the upper surface of the table by disengaging a release latch and sliding the lower end cap downwards along the ribbed plastic bar;

removing the end cap of the pivoting leg assembly by rotating the pivoting leg assembly to a horizontal position;

folding the seat back into contact with the seat bottom;

rotating each leg approximately 180 degrees from the second position to the first position; and closing the side panels to hide the legs.

5. The backpack-babychair of claim 2, wherein:

the adjustable vice like grip assembly comprises a grip housing that is configured to unidirectionally slide upwards along the ribbed plastic bar and is prevented from sliding downwards by a slug stop wedged against the ribbed plastic bar;

the grip housing comprises a trigger that is configured to exert additional incremental pressure between the upper and lower end caps and the upper and lower surfaces of the table; and the grip housing comprises a release latch that is configured to disengage the slug stop and allow the grip housing to slide downwards along the ribbed plastic bar.

6. The backpack-babychair of claim 2, wherein:

the pivoting leg assembly is configured to pivot and lock in a plurality of angles; and the end cap of the pivoting leg assembly is configured to be adjusted in height.

* * * * *